US011686479B2

(12) United States Patent
Hara et al.

(10) Patent No.: US 11,686,479 B2
(45) Date of Patent: Jun. 27, 2023

(54) ENCAPSULATED CLEANROOM SYSTEM

(71) Applicant: NATIONAL INSTITUTE OF ADVANCED INDUSTRIAL SCIENCE AND TECHNOLOGY, Tokyo (JP)

(72) Inventors: Shiro Hara, Tsukuba (JP); Hitoshi Maekawa, Tsukuba (JP); Sommawan Khumpuang, Tsukuba (JP); Takashi Yajima, Tsukuba (JP); Yuuki Ishida, Tsukuba (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 169 days.

(21) Appl. No.: 17/210,361

(22) Filed: Mar. 23, 2021

(65) Prior Publication Data

US 2021/0302034 A1 Sep. 30, 2021

(30) Foreign Application Priority Data

Mar. 27, 2020 (JP) ..... JP2020-057088

(51) Int. Cl.

| | |
|---|---|
| ***F24F 3/167*** | (2021.01) |
| ***F24F 3/04*** | (2006.01) |
| ***F24F 11/49*** | (2018.01) |
| ***F24F 11/74*** | (2018.01) |
| *F24F 110/30* | (2018.01) |
| *F24F 110/40* | (2018.01) |

(52) U.S. Cl.

CPC ..... *F24F 3/167* (2021.01); *F24F 3/04* (2013.01); *F24F 11/49* (2018.01); *F24F 11/74* (2018.01); *F24F 2110/30* (2018.01); *F24F 2110/40* (2018.01)

(58) Field of Classification Search

CPC .... F24F 3/04; F24F 3/167; F24F 11/49; F24F 11/74; F24F 2110/30; F24F 2110/40

USPC ..... 454/187

See application file for complete search history.

(56) References Cited

U.S. PATENT DOCUMENTS 5,997,398 A * 12/1999 Yamada ..... F24F 3/163 414/935
6,080,060 A * 6/2000 Larsson ..... F24F 3/167 454/236
6,569,696 B2 * 5/2003 Suenaga ..... H01L 21/67248 438/14

(Continued)

FOREIGN PATENT DOCUMENTS

JP 2012054414 A 3/2012
JP 5361002 B2 12/2013

(Continued)

*Primary Examiner* — Avinash A Savani
*Assistant Examiner* — Dana K Tighe
(74) *Attorney, Agent, or Firm* — Law Office of Katsuhiro Arai

(57) ABSTRACT

An encapsulated cleanroom system comprising a processing chamber and a storage section in which the processing chamber is stored, wherein, during operation, the pressure in the storage section is lower or higher than the pressures in the processing chamber and exterior space. The system can simultaneously prevent the entry of outside gases into its processing chamber and the leakage of the gases inside the processing chamber to the exterior space.

7 Claims, 3 Drawing Sheets

(56) References Cited

U.S. PATENT DOCUMENTS 7,925,390 B2 * 4/2011 Jingu ..... F24F 3/167
700/301

FOREIGN PATENT DOCUMENTS

JP 2014030034 A 2/2014
JP 5780531 B2 9/2015

* cited by examiner

ENCAPSULATED CLEANROOM SYSTEM

CROSS-REFERENCE TO RELATED APPLICATIONS

The present application claims priority to Japanese Patent Application No. 2020-057088, filed Mar. 27, 2020, the disclosure of which is incorporated herein by reference in its entirety including any and all particular combinations of the features disclosed therein.

BACKGROUND

Field of the Invention

The present invention relates to an encapsulated cleanroom system.

Description of the Related Art

Semiconductor devices, microchannels, micromachines, displays, thin coating films, and other products that require controlling of ambience, such as numbers of fine particles and concentrations of gases in the atmosphere, during manufacture or inspection (hereinafter also referred to as "cleanroom-manufactured products") are manufactured in cleanrooms. These products have adopted larger wafer diameters and film widths to achieve higher productivity, but because of the resulting increases in apparatus sizes, the cleanrooms are becoming expansive and the costs of installing and maintaining cleanrooms are soaring. Accordingly, the concept of creating a localized cleanroom environment, or creating a cleanroom environment only at a local area where processing is performed, is drawing attention in recent years and, for example, ultracompact production systems (minimal fabs) that are designed to create a localized cleanroom environment and handle wafers of 0.5 inches (12.5 mm) in diameter have been proposed (refer to Patent Literatures 1 and 2).

As evidenced by how semiconductor manufacturing processes, for example, must keep the oxygen concentration in gases low in order to prevent oxide films from forming on wafer surfaces, cleanroom-manufactured products require the gases inside the processing chamber to be controlled with extreme precision in terms of not only fine particle concentration and composition but also temperature, humidity, etc., where it is a must that outside gases do not enter the processing chamber.

Also, odorous gases from resists, development solutions, organic solvents, etc., or gases that are harmful to the human body or unpleasant to humans may be used, and apparatuses that use such gases must keep the gases inside the processing chamber from leaking to the exterior space.

In apparatuses designed to manufacture cleanroom-manufactured products near atmospheric pressure, the partition walls that constitute the processing chamber are not airtight enough to completely block the movement of gases, fine particles, etc., from the processing chamber to the exterior space, or from the exterior space to the processing chamber, meaning that the processing chamber and the exterior space are not completely isolated from each other. And, it is by adjusting the pressures between the processing chamber and the exterior space to let gases flow in one direction of high to low pressure, that the entry of outside gases into the processing chamber and leakage of the gases from inside the processing chamber to the exterior space are prevented. Although setting the pressure in the processing chamber higher than that in the exterior space can prevent the entry of outside gases into the processing chamber, it causes the gases inside the processing chamber to leak to the exterior space. On the other hand, setting the pressure in the processing chamber lower than that in the exterior space prevents the gases inside the processing chamber from leaking to the exterior space, but it allows outside gases to enter the processing chamber. In other words, it is difficult for the conventional apparatuses for manufacturing cleanroom-manufactured products to simultaneously prevent the entry of outside gases into the processing chamber and the leakage of the gases inside the processing chamber to the exterior space.

Background Art Literatures

[Patent Literature 1] Japanese Patent No. 5361002
[Patent Literature 2] Japanese Patent No. 5780531

SUMMARY

An object of the present invention is to provide a system that can simultaneously prevent the entry of outside gases into its processing chamber and the leakage of the gases from inside the processing chamber to the exterior space.

The means for achieving the object of the present invention are as follows.

1. An encapsulated cleanroom system comprising a processing chamber and a storage section in which the processing chamber is stored, characterized in that, during operation, the pressure in the storage section is lower or higher than the pressures in the processing chamber and exterior space.

2. The encapsulated cleanroom system according to 1, characterized in that the absolute values of pressure differences between the storage section and the processing chamber and exterior space are 0.1 Pa or greater but no greater than 10 Pa.

3. The encapsulated cleanroom system according to 1 or 2, characterized in that clean gases are supplied to the processing chamber and, during operation, the pressure in the storage section is lower than the pressures in the processing chamber and exterior space.

4. The encapsulated cleanroom system according to 1 or 2, characterized in that clean gases are supplied to the storage section and, during operation, the pressure in the storage section is higher than the pressures in the processing chamber and exterior space.

5. An apparatus into which the encapsulated cleanroom system according to any one of 1 to 4 is built.

Since the encapsulated cleanroom system proposed by the present invention has the storage section between the processing chamber and the exterior space and, during operation, the pressure in the storage section is lower or higher than the pressures in the processing chamber and exterior space, the entry of outside gases into the processing chamber and the leakage of the gases from inside the processing chamber to the exterior space can be simultaneously prevented.

The encapsulated cleanroom system proposed by the present invention, wherein the absolute values of pressure differences between the storage section and the processing chamber and exterior space are 0.1 Pa or greater but no greater than 10 Pa, allows for reduction in the sizes and weights of devices for maintaining the pressure differences and also for reduction in the quantities of gases and energy needed to maintain the pressure differences, because the pressure differences are as little as one ten-thousandth of the atmospheric pressure (101,325 Pa) or smaller.

When the pressure in the storage section is lower than the pressures in the processing chamber and exterior space, the gases inside the processing chamber as well as outside gases can move to the storage section where the pressure is lower, but the gases cannot move from the storage section to the processing chamber and exterior space where the pressure is higher. In other words, the entry of outside gases into the processing chamber and the leakage of the gases from inside the processing chamber to the exterior space can be simultaneously prevented as the storage section acts as a valley to prevent the movements of gases between the processing chamber and the exterior space.

When the pressure in the storage section is higher than the pressures in the processing chamber and exterior space, the gases inside the processing chamber as well as outside gases cannot move to the storage section where the pressure is higher. In other words, the entry of outside gases into the processing chamber and the leakage of the gases from inside the processing chamber to the exterior space can be simultaneously prevented as the storage section acts as a levee to prevent the movements of gases between the processing chamber and the exterior space.

DESCRIPTION OF THE SYMBOLS

Figure 1:
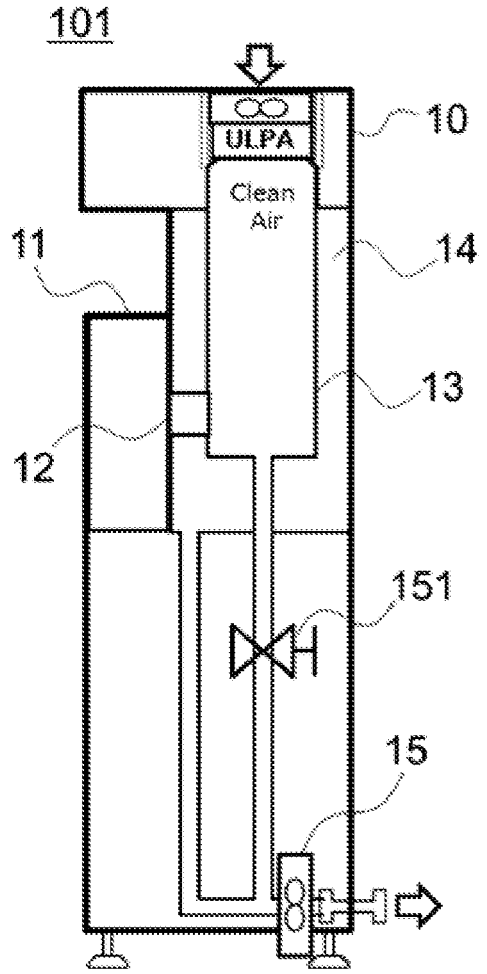
FIG. 1 is a drawing showing a simple overview of the minimal fab apparatus in the first embodiment of the present invention.

101 Minimal fab apparatus representing the first embodiment
102 Minimal fab apparatus representing the second embodiment
10 Enclosure
11 Apparatus front chamber
12 Gate valve
13 Processing chamber
14 Storage section
15 Exhaust device
151 Flow rate regulating valve

DETAILED DESCRIPTION OF EMBODIMENTS

The present invention relates to an encapsulated cleanroom system comprising a processing chamber and a storage section in which the processing chamber is stored, wherein, during operation, the pressure in the storage section is lower or higher than the pressures in the processing chamber and exterior space.

The encapsulated cleanroom system proposed by the present invention can be built into apparatuses that perform processing in a gas atmosphere. For example, it can be built into cleaning apparatus, application apparatus, exposure apparatus, developing apparatus, heating apparatus, inspection apparatus, etching apparatus, CMP (chemical mechanical planarization) apparatus, and other semiconductor manufacturing apparatuses, coating apparatus, film lamination apparatus, culturing apparatus, cell processing apparatus, etc.

The encapsulated cleanroom system proposed by the present invention represents, as described in detail below, a system that blocks the movement of gases, fine particles, etc., between the processing chamber and the exterior space. The encapsulated cleanroom system proposed by the present invention can block the processing chamber from the exterior space simply by storing the processing chamber in the storage section and controlling the pressures. This means that any apparatus into which the encapsulated cleanroom system proposed by the present invention is built need not be installed inside a cleanroom because the apparatus itself has a cleanroom function.

The processing chamber is a space where various types of processing are performed in a gas atmosphere depending on the type of apparatuses, such as cleaning, application, exposure, development, heating, inspection, etching, CMP, etc., of/on wafers, as well as coating, lamination, etc., of films, and culturing, etc., of microorganisms and cells, and separate apparatuses for performing these processing are installed therein.

Also, air, nitrogen, argon, oxygen, and other gases are supplied depending on the processing to be performed. Present in the processing chamber are resists, development solutions, organic solvents, and other sources of odorous gases, or gases that are harmful to the human body or unpleasant to humans.

The storage section stores the processing chamber. The storage section is a space adjacent to the processing chamber and isolated from the processing chamber by partition walls, and it is also a space that allows for movements of gases, fine particles, etc., to/from the processing chamber (movements between the two places). How the processing chamber is stored in the storage section is not limited in any way and, for example, the processing chamber may be fixed via a frame provided inside the storage section, or one face of the processing chamber may be welded or otherwise fixed to one face of the storage section. The component that separates the storage section and the exterior space is not limited in any way, and may be the enclosure of the apparatus, or a metal sheet, plastic sheet, air filter, glass sheet, panel computer, fan, etc. In the storage section, various pipes that connect the processing chamber and other sections of the apparatus, sensors, cameras, etc., may be provided, or chemical bottles, electronic substrates, motors, and other mechanical parts may be installed, as necessary.

In the encapsulated cleanroom system proposed by the present invention, the processing chamber and the storage section, as well as the storage section and the exterior space, are not completely isolated by physical means and therefore, during operation, gases, fine particles, etc., move between them as designed or unexpectedly. For example, providing the partition walls with openings for pipes or driven parts of driving components to run through, vent holes to let gases pass through, etc., allows gases, fine particles, etc., to move as designed. Also, when the joints, openings, etc., in the partition walls are sealed with O-rings, sheet-shaped rubber, plastic, and other elastic members, and the elastic members deform due to pressure differences during operation, gases, fine particles, etc., may move unexpectedly through the resulting gaps.

In the encapsulated cleanroom system proposed by the present invention, the pressure in the storage section is lower or higher than the pressures in the processing chamber and exterior space during operation. It should be noted that, with the encapsulated cleanroom system proposed by the present invention, during operation, the pressure in the storage section only needs to be lower or higher than the pressures in both the processing chamber and the exterior space, and the high/low relationship between the pressure in the processing chamber and that in the exterior space is not limited in any way.

During operation, preferably the absolute values of pressure differences between the storage section and the processing chamber and exterior space are 0.1 Pa or greater but no greater than 10 Pa. If these absolute values of pressure differences are smaller than 0.1 Pa, entry of outside gases into the processing chamber or leakage of the gases from inside the processing chamber to the exterior space may not be prevented fully. If the absolute values of pressure differences are greater than 10 Pa, gases may flow too fast due to the pressure differences and thus adversely affect the processing, and the quantities of gases and energy needed to maintain the pressure differences will also increase. The upper limit of the absolute values of pressure differences between the storage section and the processing chamber and exterior space, during operation, is preferably 5 Pa or lower, or more preferably 3 Pa or lower.

It should be noted that, under the present invention, "during operation" means whatever processing that matches the type of the applicable apparatus, such as cleaning, application, exposure, development, heating, inspection, etching, CMP, coating, lamination or culturing, is in progress.

Although the encapsulated cleanroom system proposed by the present invention is such that the pressure in the storage section only needs to be lower or higher than the pressures in the processing chamber and exterior space at least during processing, preferably the prescribed pressures are maintained not only during processing, but also while wafers are being transferred, the system is stopped, etc.

The encapsulated cleanroom system proposed by the present invention is explained below using minimal fab apparatuses as examples. It should be noted that minimal fab apparatuses are apparatuses that constitute ultracompact device production systems (minimal fabs) that are designed to create a localized cleanroom environment and handle wafers of 0.5 inches (12.5 mm) in diameter. By building the encapsulated cleanroom system proposed by the present invention into such minimal fab apparatuses, the aforementioned entry of outside gases into the processing chamber, and leakage of the gases from inside the processing chamber to the exterior space, can be simultaneously prevented.

First Embodiment

FIG. 1 is a conceptual view of the minimal fab apparatus 101 representing the first embodiment.

The minimal fab apparatus 101 representing the first embodiment comprises an enclosure 10, an apparatus front chamber 11 for taking out wafers stored in a sealed transfer container, a gate valve 12, a processing chamber 13 where wafers receive various processing, and a storage section 14. It should be noted that, in this Specification, the same members are denoted by the same symbols.

The apparatus front chamber 11 is a chamber for removing wafers stored in a sealed transfer container and transferring them to the processing chamber 13. The gate valve 12 is provided between the apparatus front chamber 11 and the processing chamber 13, and the wafers removed from the sealed transfer container are carried into the processing chamber 13 from the apparatus front chamber 11 through this gate valve 12.

The processing chamber 13 has clean air supplied to it that has passed through an ULPA filter provided above.

The storage section 14 is a space adjacent to the processing chamber 13 and isolated from the processing chamber 13 by partition walls, and it is also a space that allows for movement of gases, fine particles, etc., to/from the processing chamber 13 (movement between the two places). In this first embodiment, the storage section 14 is formed between the processing chamber 13 and the enclosure 10. Also, the bottom face of the storage section 14 is separated from other sections, such as a mechanical chamber and chemical chamber, by metal sheets.

The processing chamber 13 and storage section 14 are connected to the same exhaust device 15, and a flow rate regulating valve 151 is provided on the exhaust pipe connecting the processing chamber 13 and the exhaust device 15. Since the processing chamber 13 and storage section 14 are connected to the same exhaust device 15, the storage section 14 can be preferentially exhausted to bring the pressure in the storage section 14 lower than the pressures in the processing chamber 13 and exterior space by adjusting the degree of opening of this flow rate regulating valve 151 to achieve a prescribed pressure difference between the processing chamber 13 and the storage section 14 so that the exhaust flow rate per processing chamber volume becomes lower than the exhaust flow rate per storage section volume. Also, exhausting brings the pressure in the storage section 14 lower than the pressure in the exterior space.

Here, the processing chamber 13 is not completely isolated from the storage section 14 by physical means. Therefore, during operation, gases leak from the processing chamber 13 where the pressure is higher, to the storage section 14 where the pressure is lower. However, the storage section 14 is lower in pressure than the exterior space and therefore the gases do not leak from the storage section 14 to the exterior space. Similarly, outside gases entering from the exterior space to the storage section 14 where the pressure is lower, cannot enter the processing chamber 13 where the pressure is higher than in the storage section 14.

The minimal fab apparatus 101 representing the first embodiment allows both the gases inside the processing chamber 13 and the outside gases to enter the storage section 14, but gases cannot move from the storage section 14 to the processing chamber 13 or exterior space. In other words, the minimal fab apparatus 101 representing the first embodiment can simultaneously prevent the entry of outside gases into the processing chamber 13 and the leakage of the gases from inside the processing chamber 13 to the exterior space, as the storage section 14 acts as a gully to prevent the movements of gases between the processing chamber 13 and the exterior space.

Second Embodiment

Figure 2:
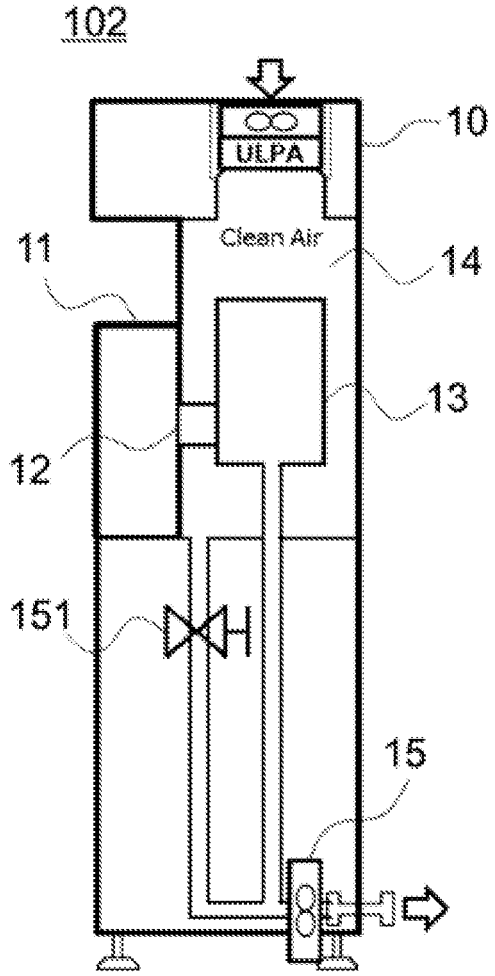
FIG. 2 is a drawing showing a simple overview of the minimal fab apparatus in the second embodiment of the present invention.

FIG. 2 shows a conceptual view of the minimal fab apparatus 102 representing the second embodiment.

In the minimal fab apparatus 102 representing the second embodiment, the pressure in the storage section 14 is higher than the pressures in the processing chamber 13 and exterior space. The following explains primarily the differences from the first embodiment.

In the minimal fab apparatus 102 representing the second embodiment, a processing chamber 13 is stored in a storage section 14. The storage section 14 has clean air supplied to it that has passed through an ULPA filter provided above, and is higher in pressure than the exterior space. The processing chamber 13 is not completely isolated from the storage section 14 by physical means, and the clean air supplied to the storage section 14 also enters into the processing chamber 13.

The processing chamber 13 and storage section 14 are connected to the same exhaust device 15, and a flow rate regulating valve 151 is provided on the exhaust pipe connecting the storage section 14 and the exhaust device 15. Since the processing chamber 13 and storage section 14 are connected to the same exhaust device 15, the processing chamber 13 can be preferentially exhausted to bring the pressure in the storage section 14 higher than the pressure in the processing chamber 13 by adjusting the degree of opening of this flow rate regulating valve 151 to achieve a prescribed pressure difference between the processing chamber 13 and the storage section 14 so that the exhaust flow rate per storage section volume becomes lower than the exhaust flow rate per processing chamber volume.

Because the storage section 14 is higher in pressure than the processing chamber 13, the gases inside the processing chamber 13 do not leak to the storage section 14. Similarly, outside gases cannot enter the storage section 14 where the pressure is higher. In other words, the minimal fab apparatus 102 representing the second embodiment can simultaneously prevent entry of outside gases into the processing chamber 13 and the leakage of the gases from inside the processing chamber 13 to the exterior space, as the storage section 14 acts as a levee to prevent the movements of gases between the processing chamber 13 and the exterior space.

The minimal fab apparatuses representing the first and second embodiments are compact manufacturing apparatuses designed to handle wafers of 0.5 inches (12.5 mm) in diameter, and therefore have shorter sealing distances, are easy to ensure airtightness of the storage section, and thus the amount of supply/exhaust flow can be reduced. As a result, they require lower costs of energy associated with the supply/exhaust devices and can be made quieter. Also, the compactness of the apparatus translates to a smaller spatial volume that requires differential pressure control, as well as a good time response of differential pressure, allowing a set differential pressure to be reached in a short period of time. Furthermore, established enclosure standards are available for minimal fab apparatuses, which eliminates the need to design an airtight storage section structure separately for each apparatus.

It should be noted that the minimal fab apparatuses representing the first and second embodiments are only examples and the encapsulated cleanroom system proposed by the present invention are not limited to these embodiments. For example, the encapsulated cleanroom system proposed by the present invention is not limited to minimal fab apparatuses designed to handle wafers of 0.5 inches (12.5 mm) in diameter; instead, it may constitute a semiconductor manufacturing apparatus designed to handle wafers of other sizes such as 6 inches (150 mm) and 12 inches (300 mm), coating apparatus, film lamination apparatus, culturing apparatus, cell processing apparatus, etc. Additionally, the differential pressure may be controlled according to the exhaust flow rate, supply flow rate, or both, or the exhaust flow rate and supply flow rate may be controlled by monitoring the pressures in the processing chamber and storage section using pressure sensors. Also, HEPA filters and other types of particle filters may be used instead of ULPA filters.

EXAMPLE

The minimal fab apparatus having a constitution similar to that of the first embodiment was used. The minimal fab apparatus used in the Example is for R&D use, and three faces—side faces and rear face—of its enclosure are covered with polyvinyl chloride sheets for ease of internal adjustments.

A beaker of 50 ml in capacity containing 20 ml of ethanol as a source of odor was placed inside the processing chamber, and clean air was supplied to the processing chamber at 30 L/min. Using the exhaust device, the pressures in the processing chamber and storage section were controlled as follows relative to the exterior pressure. It should be noted that the processing chamber can have positive pressure relative to the exterior pressure because of the supply of clean air:

1) Processing chamber: +0.5 Pa, Storage section: −3.3 Pa 5 min

2) Processing chamber: +0.5 Pa, Storage section: +0.5 Pa 5 min

3) Processing chamber: +0.5 Pa, Storage section: −3.3 Pa 10 min

4) Processing chamber: +0.5 Pa, Storage section: +0.5 Pa 5 min

Figure 3:
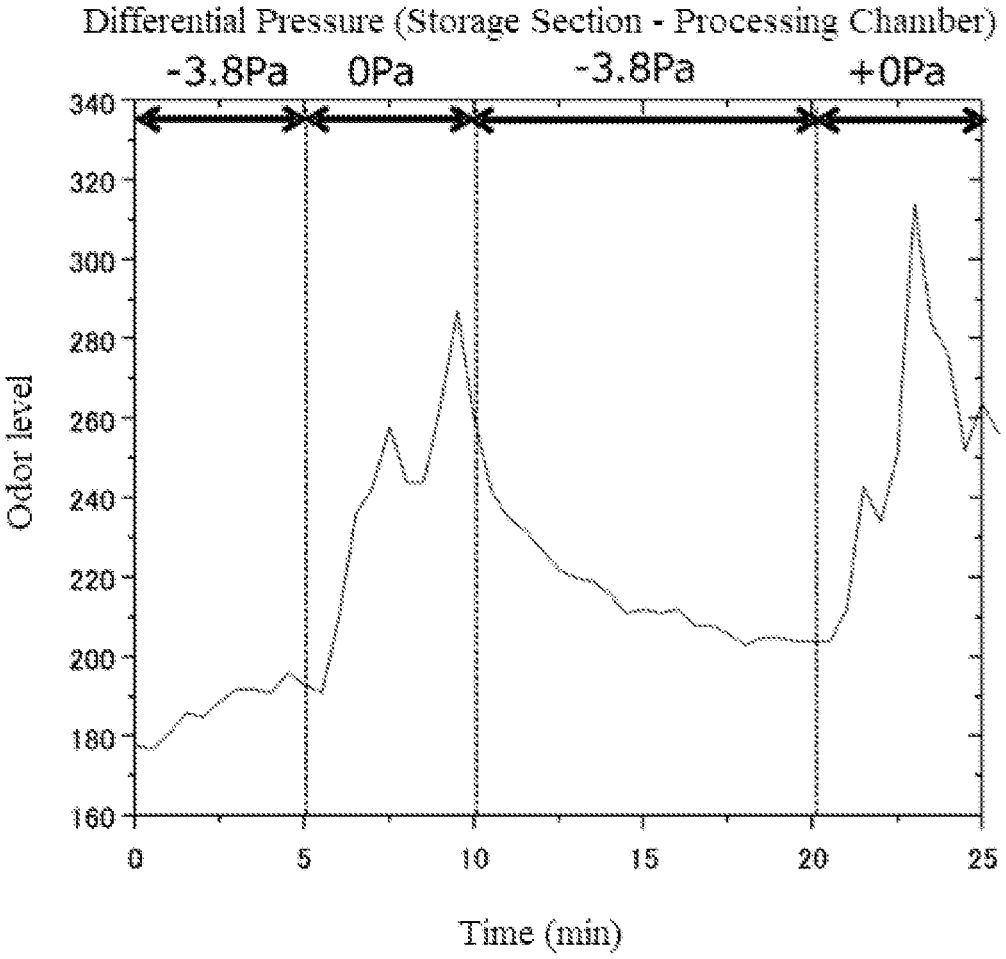
FIG. 3 is a graph showing how the odor level changes over time in the Example.

Odor at a point approx. 5 cm from the rear face of the enclosure and 1 m above the floor was measured using a portable odor sensor (XP-329IIIR by New Cosmos Electric Co., Ltd.), to check for leakage of ethanol from inside the processing chamber. How the odor level changed over time is shown in FIG. 3.

Result

When the storage section was lower in pressure than the processing chamber and exterior space, the odor level was low, indicating that the leakage of ethanol from inside the processing chamber to the exterior space could be prevented. When the processing chamber and the storage section were equal in pressure, on the other hand, the odor level rose rapidly, suggesting that ethanol had leaked form inside the processing chamber to the exterior space.

In this experiment, the entry of fine particles from the exterior space into the processing chamber was prevented at all times because the processing chamber was constantly supplied with clean air and also maintained positive pressure relative to the exterior space. This means that, by keeping the storage section lower in pressure than the processing chamber and exterior space, the entry of outside gases into the processing chamber and the leakage of the gases from inside the processing chamber to the exterior space could be simultaneously prevented.

We claim:

1. An encapsulated cleanroom system comprising a processing chamber and a storage section in which the processing chamber is stored, characterized in that, during operation, a pressure in the storage section is lower or higher than pressures in the processing chamber and exterior space, wherein clean gases are supplied to the processing chamber and, during operation, the pressure in the storage section is lower than the pressures in the processing chamber and exterior space.

2. The encapsulated cleanroom system according to claim 1, characterized in that absolute values of pressure differences between the storage section and the processing chamber and exterior space are 0.1 Pa or greater but no greater than 10 Pa.

3. An apparatus into which the encapsulated cleanroom system according to claim 1 is built.

4. An encapsulated cleanroom system comprising a processing chamber and a storage section wherein the storage section surrounds a circumference of the processing chamber along a direction of clean gases flow in the processing chamber, and, during operation, a pressure in the storage section is lower or higher than pressures in the processing chamber and exterior space, wherein clean gases are supplied to the storage section and, during operation, the pressure in the storage section is higher than the pressures in the processing chamber and exterior space.

5. The encapsulated cleanroom system according to claim 4, characterized in that absolute values of pressure differences between the storage section and the processing chamber and exterior space are 0.1 Pa or greater but no greater than 10 Pa.

6. An apparatus into which the encapsulated cleanroom system according to claim 4 is built.

7. An encapsulated cleanroom system comprising:

a processing chamber serving as a cleanroom wherein an enclosure of the processing chamber defining an operation interior is gas-leakable;

a storage compartment encapsulating the processing chamber wherein an enclosure of the storage compartment defining an intermediate interior surrounding the processing chamber is gas-leakable;

a gas supply structure supplying an in-flow gas from the ambient space exterior to the storage compartment to the processing chamber, wherein the intermediate interior is a space isolated from the operation interior by partition walls of the processing chamber, and the in-flow gas is supplied from the operation interior to the intermediate interior through the partition walls of the processing chamber;

a gas exhaust structure discharging an out-flow gas from the processing chamber and the storage compartment, wherein the gas exhaust structure is constituted by a first gas line connecting the operation interior to a gas exhaust port, and a second gas line connecting the intermediate interior to the gas exhaust port, wherein a flow-restriction valve is provided in the first gas line to discharge a gas from the intermediate interior in an amount higher than an amount of a gas discharged from the operation interior, so that the pressure of the intermediate interior is lower than the pressure of the operation interior as well as the pressure of the ambient space exterior to the storage compartment; and a gas-flow controller controlling flow of the in-flow gas and/or the out-flow gas in a manner that a pressure of the intermediate interior is lower than a pressure of the operation interior as well as a pressure of ambient space exterior to the storage compartment, or the pressure of the intermediate interior is higher than the pressure of the operation interior as well as the pressure of ambient space exterior to the storage compartment, thereby suppressing a gas of the operation interior from being discharged to the ambient space or suppressing a gas of the ambient space entering into the operation interior.

* * * * *